US007890038B2

(12) United States Patent
Chikugo et al.

(10) Patent No.: US 7,890,038 B2
(45) Date of Patent: Feb. 15, 2011

(54) IMAGE HEATING APPARATUS

(75) Inventors: Youichi Chikugo, Toride (JP); Seiichiro Kameda, Abiko (JP); Taiya Hirayama, Toride (JP); Masashi Sawada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 438 days.

(21) Appl. No.: 12/098,097

(22) Filed: Apr. 4, 2008

(65) Prior Publication Data

US 2008/0260435 A1 Oct. 23, 2008

(30) Foreign Application Priority Data

Apr. 20, 2007 (JP) ..... 2007-111166

(51) Int. Cl.
*G03G 15/20* (2006.01)

(52) U.S. Cl. ..... 399/323; 399/122; 399/320; 399/328; 399/329; 399/330

(58) Field of Classification Search ..... 399/122, 399/320, 323, 328–330
See application file for complete search history.

(56) References Cited

U.S. PATENT DOCUMENTS

2002/0141792 A1* 10/2002 Nakano et al. ..... 399/323
2005/0207771 A1 9/2005 Kameda
2006/0131301 A1 6/2006 Ohta et al.
2006/0157475 A1 7/2006 Nishihara et al.
2007/0059060 A1* 3/2007 Kameda et al. ..... 399/329

FOREIGN PATENT DOCUMENTS

JP 4-316076 11/1992

* cited by examiner

*Primary Examiner*—Ryan D Walsh
(74) *Attorney, Agent, or Firm*—Fitzpatrick, Cella, Harper & Scinto

(57) ABSTRACT

The present invention provides an image heating apparatus capable of holding an open/close unit at a normal position and capable of inexpensively avoiding conveyance failure and deterioration in image quality. An image heating apparatus includes a fixing an roller 71 and a pressing belt 731, a pressing mechanism 75 which rotates a pressing belt unit 73 having a pressing belt 731 to retract the pressing belt 731 from a pressing contact position, a separation projection 800 which separates the sheet S from the pressing belt 731, and an open/close unit 81 which rotates a separating unit (separation projection 800, division plate 817) to retract the separation projection 800 from a separating position. The pressing belt unit 73 includes a push-up member 840 which locks the separating unit located in the separating position when the pressing belt unit 73 is in the pressing contact position.

7 Claims, 15 Drawing Sheets

IMAGE HEATING APPARATUS

BACKGROUND OF THE INVENTION

1. Field of the Invention

The present invention relates to an image heating apparatus which is used for an image forming apparatus such as an electro photographic device and an electrostatic recording device and which heats an image formed on a sheet.

2. Description of the Related Art

In an image forming apparatus such as the electro photographic device and the electrostatic recording device, a toner image is formed on the sheet, the toner image is heated, pressurized and fixed, thereby forming an image. As an apparatus which carries out such a fixing operation, there is an apparatus which forms a fixing nip by a heating member and a pressing member which pressurizes the heating member, and the fixing operation is carried out while nipping and conveying the sheet between the heating member and the pressing member.

In such a fixing apparatus (image heating apparatus), there is an apparatus in which a conveying roller behind a fixing nip can be separated from a fixing apparatus so that a user, a service man or an operator can perform maintenance or remove a remaining paper sheet (see Japanese Patent Application Laid-open No. 4-316076).

Conventionally, as shown in FIG. 14, after a pullout unit 1092 fixed to a pullout rail 1091 is pulled out from a casing of an image forming apparatus 1001, maintenance of a fixing apparatus 1005 placed on the pullout unit 1092 is carried out.

As shown in FIG. 15A, the fixing apparatus 1005 includes a fixing roller 1071 and a pressing belt 1731 which forms a nip portion between the pressing belt 1731 and the fixing roller 1071. In the fixing apparatus 1005, a separation projection 1800 and a division plate 1817 are provided adjacent to the pressing belt 1731 and the fixing roller 1071.

An open/close unit 1081 includes a pair of rotate arms 1085 which respectively holds both ends of the separation projection 1800, the division plate 1817, and a pair of conveying rollers 1082 (only one ends thereof are illustrated in FIG. 15). The separation projection 1800 is urged against the pressing belt 1731 by a tension spring in a state where the pressing belt 1731 abuts against the fixing roller 1071 for separating a sheet from the pressing belt 1731.

As shown in FIG. 15B, the open/close unit 1081 can rotate around a rotate shaft 1819 in a direction separating from the fixing roller 1071 and the pressing belt 1731 (direction of the arrow A'). Thus, the separation projection 1800, the division plate 1817 and the pair of conveying rollers 1082 can retract from the fixing roller 1071 and the pressing belt 1731 in the direction of the arrow C'.

In such an apparatus, when accessing the fixing apparatus for maintenance or jam recovery at the fixing portion, the pressing belt 1731 is separated from the fixing roller 1071 and the pressure is released. Then, the open/close unit 1081 is rotated to form a space for maintenance so that a user or an operator can access the fixing apparatus.

However, a power supply is suddenly shut off due to a power failure or trouble in a state where the fixing roller 1071 and the pressing belt 1731 are pressurized, or the fixing roller 1071 and the pressing belt 1731 are not separated from each other due to malfunction and the operation is stopped in the pressurized state in some cases.

Conventionally, an operator can operate the open/close unit 1081 even in a state where the pressing belt 1731 and the separation projection 1800 are in abutment against each other. Thus, in the conventional apparatus, there is a danger that the separation projection 1800 pressed against the pressing belt 1731 scrapes against the pressing belt 1731 excessively at the time of opening operation of the open/close unit 1081.

If the pressing belt 1731 scrapes against the separation projection 1800 excessively, a flaw which can not be negligible is generated on a surface of the pressing belt 1731. There is a danger that such a phenomenon occurs even when the separation projection and the pressing belt are disposed at a slight distance away from each other.

If such a flaw is generated in the pressing belt, endurance and lifetime of the pressing belt are deteriorated. There is an adverse possibility that image failure is generated. In particular, when images are to be formed on both surfaces of a sheet, if an image formed on a first surface of the sheet comes into contact with the pressing belt 1731, a flaw generated on the pressing belt 1731 is transferred to that image. With this, uneven brightness (gloss unevenness) is generated on the image of the first surface of the sheet, and the image quality is degraded. This gloss unevenness appears seriously especially when a high gloss image is formed.

SUMMARY OF THE INVENTION

The present invention provides An image heating apparatus comprising: a heating member configured to heat a toner image on a sheet at a nip portion; a pressing unit including a pressing member configured to form the nip portion with the heating member; a pressing unit moving device configured to move the pressing unit between an image heating position where an image heating process is executed and a retracted position where the pressing unit is retracted relative to the heating member; a separating unit including a separating member configured to separate the sheet from the pressing member, the separating unit is movable between a separating position where a separating process is executed and a retracted position where the separating unit is retracted relative to the pressing unit; wherein the pressing unit includes an abutting portion configured to abut on the separating unit which is in the retracted position so that the separating unit is positioned at the separating position with a moving operation of the pressing unit from the retracted position to the image heating position.

The present invention provides an image heating apparatus capable of suppressing the degradation of a pressing member (corresponding to the pressing belt) when a separating unit (corresponding to the open/close unit) is operated.

Other objects of the invention will become clear by the following detailed description of the invention with reference to the accompanying drawings.

Further features of the present invention will become apparent from the following description of exemplary embodiments with reference to the attached drawings.

DESCRIPTION OF THE EMBODIMENTS

An embodiment of an image heating apparatus according to the present invention will be described using the drawings.

(Image Forming Apparatus)

Figure 1:
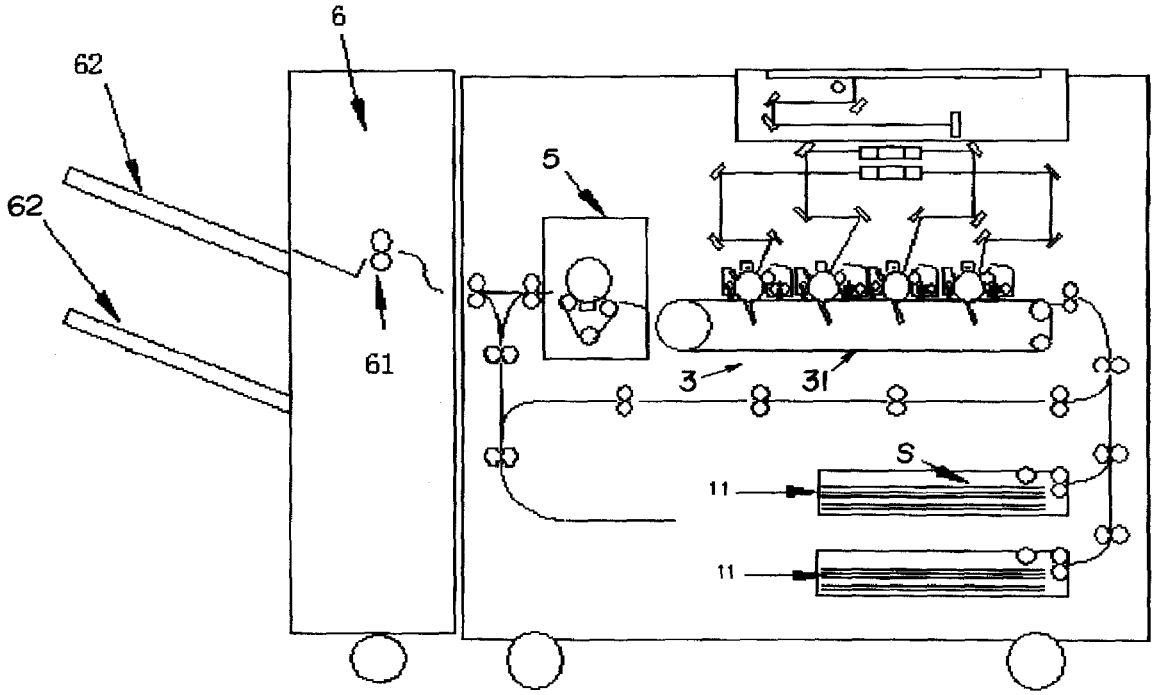
FIG. 1 is a sectional view of an image forming apparatus.
Figure 2:
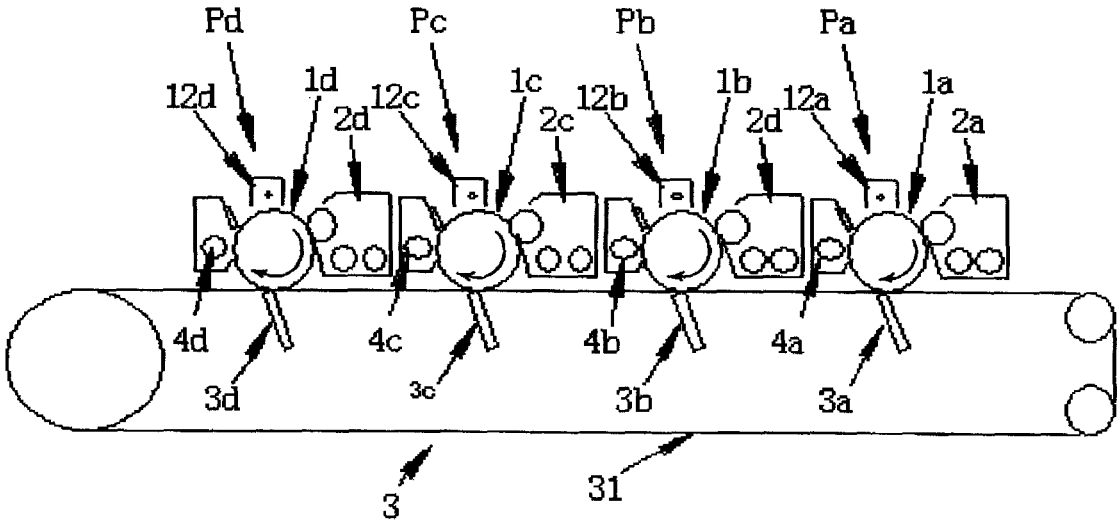
FIG. 2 is a sectional view of an image forming unit.

FIG. 1 is a sectional view of an image forming apparatus (laser beam printer) according to the embodiment. FIG. 2 is a sectional view of an image forming portion.

As shown in FIG. 1, four image forming stations Pa, Pb, Pc and Pd which are image forming units are provided in an apparatus main body. These image forming stations Pa to Pd form toner imagers of magenta, cyan, yellow and black, respectively.

As shown in FIG. 2, the image forming stations Pa, Pb, Pc and Pd respectively include photoconductive drums 1*a*, 1*b*, 1*c* and 1*d* which are image bearing members rotated in the direction of the arrow in FIG. 2. Chargers 12*a*, 12*b*, 12*c* and 12*d*, developing devices 2*a*, 2*b*, 2*c* and 2*d* and cleaners 4*a*, 4*b*, 4*c* and 4*d* are sequentially disposed around the photoconductive drums 1*a*, 1*b*, 1*c* and 1*d* along the rotating direction of the photoconductive drums 1*a*, 1*b*, 1*c* and 1*d*. A transfer portion 3 is disposed below the photoconductive drums 1*a*, 1*b*, 1*c* and 1*d*. The transfer portion 3 includes a transfer belt 31 and transfer chargers 3*a*, 3*b*, 3*c* and 3*d*. The transfer belt 31 is a recording convey means which is common for the image forming stations Pa, Pb, Pc and Pd.

A sheet S as a sheet supplied from a sheet cassette 11 which is a supply unit is supported on a transfer belt 31 and conveyed to the image forming stations Pa, Pb, Pc and Pd, and toner images of colors formed on the photoconductive drums 1*a*, 1*b*, 1*c* and 1*d* are sequentially transferred to the sheet S. The sheet S to which the toner image is transferred is separated from the transfer belt 31 and conveyed to the fixing apparatus 5. The toner image transferred to the sheet S by the fixing apparatus 5 is fixed onto the sheet S by heat and pressure, and the toner image is conveyed to a discharge processing device 6. In the discharge processing device 6, the sheet S is discharged onto a discharge tray 62 by a conveying roller 61. The discharge tray 62 moves downward so that a large number of sheets can be discharged and stacked. The discharge processing device 6 can also perform stapling of a large number of sheets S.

(Image Heating Apparatus)

A structure of the fixing apparatus 5 which is one example of the image heating apparatus will be described using FIGS. 3 to 7.

Figure 3:
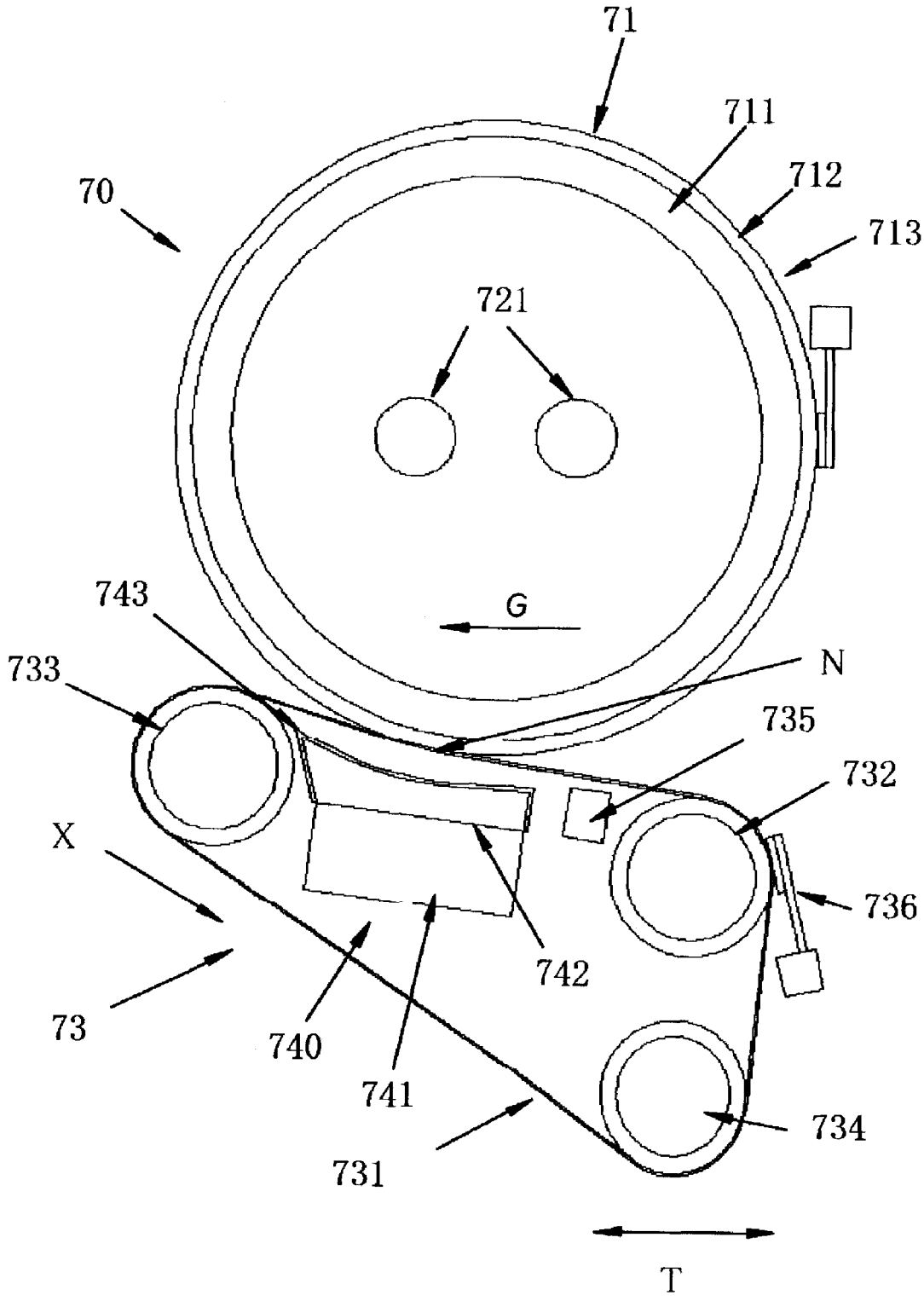
FIG. 3 is a sectional view of a fixing apparatus.

As shown in FIG. 3, the fixing apparatus 5 includes a fixing roller unit 70 and a pressing belt unit 73.

The fixing roller unit 70 as a heating unit includes a fixing roller 71 as a heating member and a heater 721.

The fixing roller 71 is provided with an elastic layer 712 made of silicon rubber on a surface layer of a core bar 711 made of aluminum. A toner parting layer 713 is provided on a surface layer of the elastic layer 712. The toner parting layer 713 comprises a PFA tube. The toner parting layer 713 enhances the mold-releasing performance. The heater 721 is disposed near a center in the fixing roller.

In the pressing belt unit 73 as a pressing unit, a pressing belt 731 which is an endless belt as a pressing member is stretched around an inlet roller 732, a separation roller 733 and a steering roller 734. The pressing belt unit 73 pressurizes the fixing roller 71 and forms a fixing nip N as a nip portion. The pressing belt unit 73 can rotate around a rotate shaft 754 located closer to the pressing member relative to a sheet conveying path with respect to the fixing roller 71.

One end of the steering roller 734 can move in the direction of the arrow T, and corrects a deviation of the pressing belt 731. The fixing roller 71 and the pressing belt 731 are a heating member and a pressing member for nipping and conveying a sheet S for heating an image formed on the sheet S.

A pressing pad portion 740 is disposed in the belt. The pressing pad portion 740 includes a base 741 made of metal such as SUS, a pressing pad 742 made of silicon rubber, and a slide sheet 743 made of PI film. The slide sheet 743 is disposed between the pressing pad 742 and the pressing belt 731.

An oil application member 735 is provided between the inlet roller 732 and the pressing pad portion 740. Silicon oil is impregnated into the oil application member 735, the oil application member 735 applies oil to an inner surface of the pressing belt 731, and reduces friction force between the pressing belt 731 and the slide sheet 743. A thermistor 736 which measures the temperature of the pressing belt surface is disposed near the inlet roller 732.

(Pressing Mechanism 75)

Figure 4:
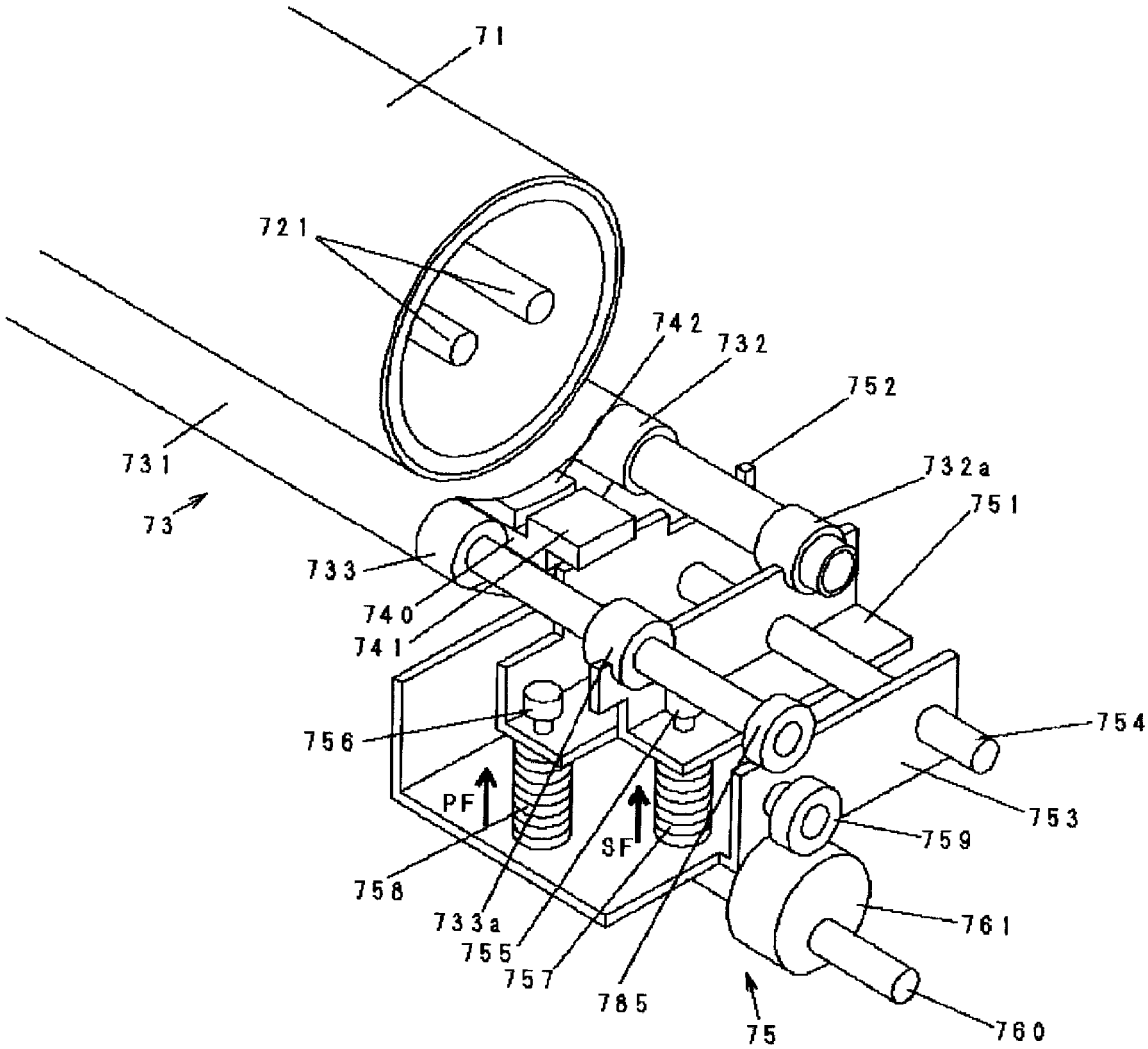
FIG. 4 is a perspective view of a pressing unit.

Next, pressing mechanisms 75 as pressing unit rotating devices for pressing the pressing belt unit 73 against the fixing roller 71 will be described using FIGS. 4 and 5. The pressing mechanisms 75 are provided on both ends of the pressing belt unit 73. Since both the pressing mechanisms 75 are substantially the same, only one of the pressing mechanisms 75 is shown in FIG. 4.

The pressing mechanism 75 is a rotating mechanism for rotating the pressing belt unit 73 having a pressing belt 731 to retract the pressing belt 731 from a pressing contact position where the fixing processing (image heating processing) can be carried out. As shown in FIG. 4, the pressing mechanism 75 includes a roller pressing holder 751, a pad pressing holder 752, a pressing holder 753, a roller pressing spring 757 and a pad pressing spring 758.

The roller pressing holder 751 supports a bearing 732*a* on an end of a fixing inlet roller 732 and a bearing 733*a* on an end of the separation roller 733 such that the roller pressing holder 751 can push up the bearings 732*a* and 733*a*. The pad pressing holder 752 supports an end of a base 741 of the pressing pad portion 740 such that the pad pressing holder 752 can push up the end of the base 741. A pressing holder 753 is disposed below the roller pressing holder 751 and the pad pressing holder 752. Holders 751 to 753 are pivotally supported by the rotate shaft 754 such that the holders 751 to 753 can rock.

The roller pressing spring 757 is disposed between the pressing holder 753 and the roller pressing holder 751. A guide shaft 755 fixed to the pressing holder 753 passes through the roller pressing spring 757 and passes through a hole formed in the roller pressing holder 751.

The pad pressing spring 758 is disposed between the pressing holder 753 and the pad pressing holder 752. A guide shaft 756 fixed to the pressing holder 753 passes through the pad pressing spring 758 and passes through a hole formed in the pad pressing holder 752.

The pressing holder 753 is provided at its side surface with a receiver 759. A pressing cam 761 is provided below the receiver 759. The pressing cam 761 rotates around a rotate shaft 760 as an eccentric shaft to vertically move the receiver 759.

Figure 5A:
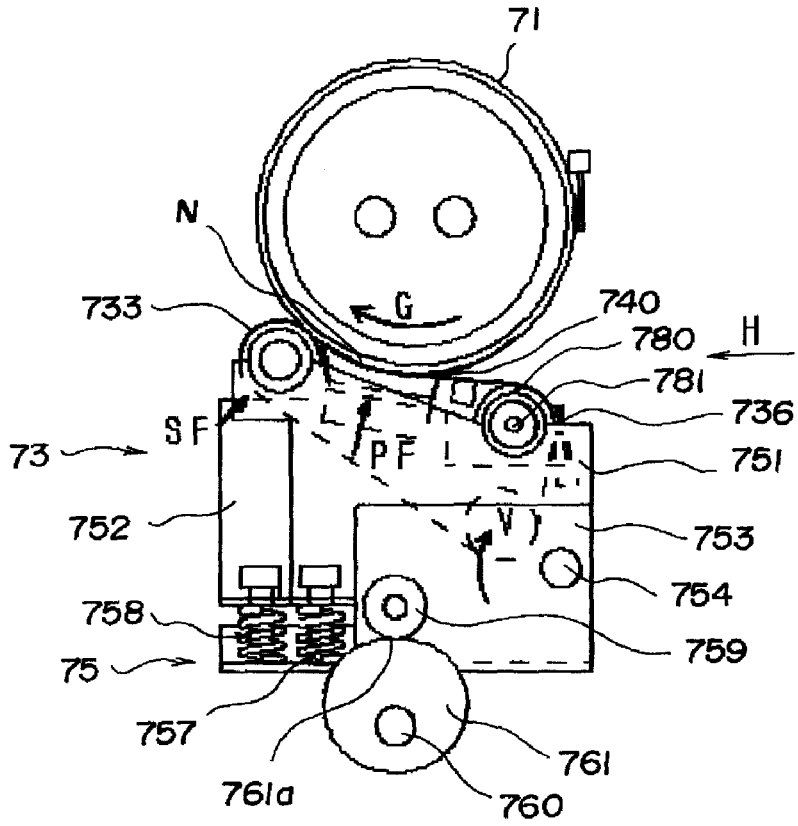
FIGS. 5A and 5B are sectional views for describing pressing and separating motion of the pressing unit.
Figure 5B:
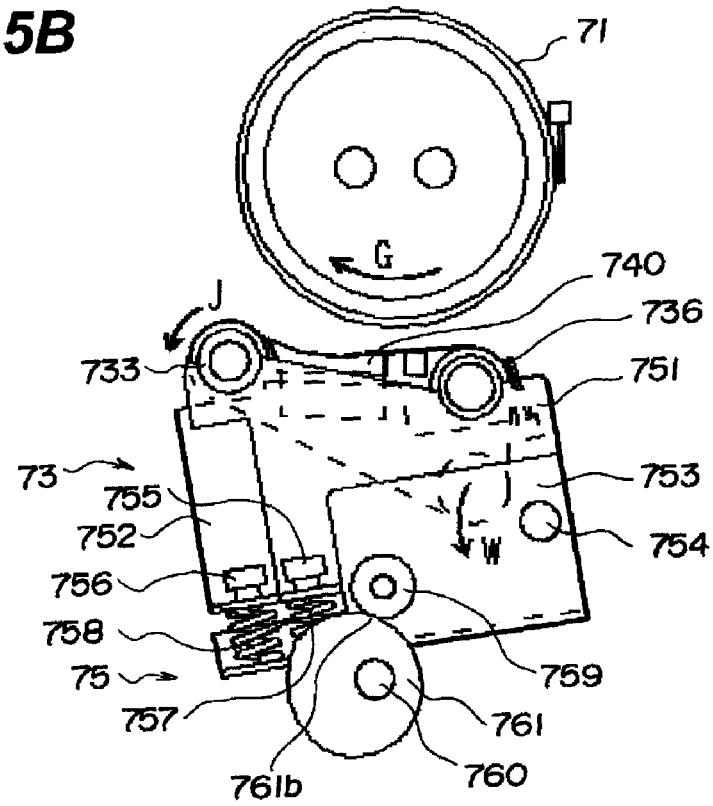

FIG. 5A illustrates a state where the pressing belt unit 73 is pressurized by the fixing roller 71. FIG. 5B illustrates a state where the pressing belt unit 73 retracts from the fixing roller 71.

As shown in FIG. 5A, a controller operates a driving system connected to a pressing cam, thereby rotating the pressing cam 761 around the rotate shaft 760, and a long diameter portion 761*a* of the pressing cam 761 is located on a top (position where the pressing cam 761 abuts against the receiver 759). In this state, the receiver 759 is pushed upward and the pressing holder 753 rotates around the rotate shaft 754 toward the fixing roller 71 (in the direction of the arrow V).

With this, the roller pressing holder 751 rotates around the rotate shaft 754 by an urging force of the roller pressing spring 757, and the separation roller 733 is pressurized by the fixing roller 71 under a pressing force SF. Similarly, the pad pressing holder 752 rotates around the rotate shaft 754 by an urging force of the pad pressing spring 758, and the pressing pad portion 740 is pressurized by the fixing roller 71 under a pressing force PF.

If the fixing roller 71 is rotated in the direction of the arrow G in this state, the pressing belt 731 is also rotated such as to follow the fixing roller 71. The sheet S is conveyed from the direction of the arrow H and if the sheet S is nipped between nips N formed between the fixing roller 71 and the pressing belt 731, toner on the sheet S is melted by heat of the fixing roller 71 and the pressing belt 731, and the toner is pushed against the sheet S by the pressure of the pressing pad portion 740 and fixed to the sheet S.

As shown in FIG. 5B, the controller operates the driving system connected to the pressing cam, thereby rotating the pressing cam 761 around the rotate shaft 760, and a short diameter portion 761*b* of the pressing cam 761 abuts against the receiver 759. In this state, the receiver 759 is lowered from the state shown in FIG. 5A, and the pressing holder 753 rotates in a direction (direction of the arrow W) separating away from the fixing roller 71 around the rotate shaft 754.

With this, the urging force of the roller pressing spring 757 is not applied, the roller pressing holder 751 rotates around the rotate shaft 754 and the separation roller 733 separates from the fixing roller 71. Similarly, the urging force of the pad pressing spring 758 is not applied, the pad pressing holder 752 rotates around the rotate shaft 54 and the pressing pad portion 740 separates from the fixing roller 71.

When convey failure (jam) of a sheet is generated or when image output is awaited (standby state), control is performed such that the pressing belt unit assumes a position retracted from the fixing roller (FIG. 5B). That is, the pressing belt 731, the separation roller 733 and the pressing pad portion 740 are separated from the fixing roller 71.

If the pressing belt 731 is stopped, the temperature of only a portion of the pressing belt 731 that is close to the inlet roller 780 rises due to heat from a belt heater 781 provided in the inlet roller 780. Hence, the separation roller 733 is rotated in the convey direction (direction of the arrow J). At that time, if the fixing roller 71 is also rotated, the temperature variation of the fixing roller 71 is not generated.

(Separating Structure)

Figure 6:
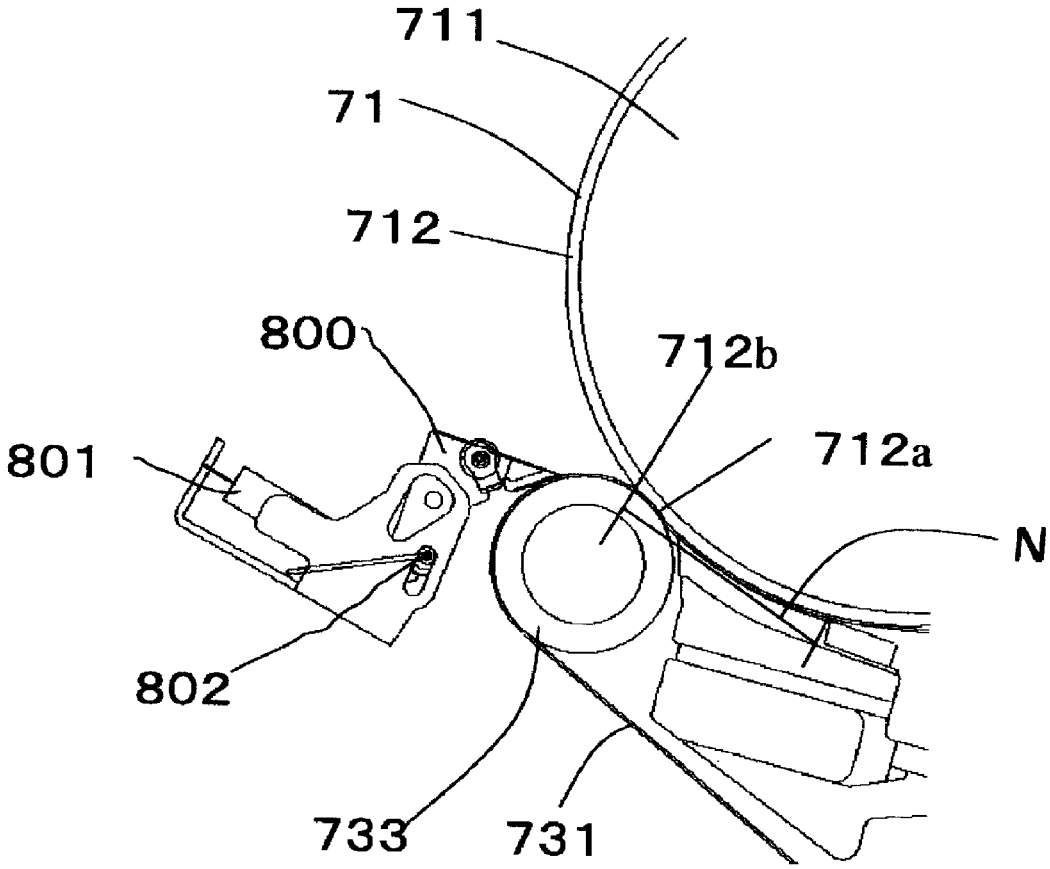
FIG. 6 is a sectional view of a separating member.

A separating structure after the sheet S passes through the fixing nip will be described using FIG. 6 next. FIG. 6 is an enlarged diagram of the separation roller 733. As shown in FIG. 6, since the metal separation roller 733 is pressurized by the fixing roller 71 through the pressing belt 731 by a pressing unit, the elastic layer 712 of the fixing roller 71 is recessed in a form of an arc. Especially at an end of the fixing roller 71 which is in contact with the separation roller 733, the arc shape of the elastic layer 712 swells in the opposite direction and that portion projects.

Since toner on the sheet S is melted and pressurized by the nip N of the fixing apparatus 5, the toner and a surface layer of the fixing roller adhere to each other by the surface tension. However, the arc shape swells in the opposite direction by the separation roller 733 at the elastic layer 712*b* of the fixing roller 71. Therefore, the toner which adheres to the fixing roller 71 is peeled off.

The pressing belt 731, a separation projection (separating member) 800 which separates the sheet S from the fixing roller 71 and a division plate (separating member) 817 are provided correspondingly downstream in the conveying direction of the nip N. The separation projection 800 and the division plate 817 are unitized as a separating unit, and they can rotate around a rotate shaft 819 located closer to the heating member relative to the sheet conveying path with respect to the pressing belt unit 73.

The sheet S is crumpled by the elastic layer 712 and the separation roller 733 and is made harder in the direction of the pressing belt 731. Therefore, it becomes easy to wind the tip end around the pressing belt 731, the separation projection (separating member) 800 is brought into contact with the pressing belt 731 and the sheet S is separated from the pressing belt 731. The separation projection 800 scrapes a tip end of the sheet S on the pressing belt 731 and assists the separating operation of the sheet S from the surface of the pressing belt 731.

The separation projection 800 has a sharp tip end to reliably separate the sheet S. Since the tip end requires high precision, material such as polyimide (PI) or polyamide-imide (PAI) having high heat-resistance and hardness is used for the separation projection 800. To enhance the mold-releasing performance of the separation projection 800, its tip end surface is coated with fluoroplastics.

If the thickness of the sheet S is reduced, a tip end of the sheet S enters between the separation projection 800 and the fixing roller when the separation projection 800 is not in contact with the pressing belt 731, and this hinders the conveying motion of the sheet. Thus, the separation projection 800 is urged toward the pressing belt 731 by the tension spring (urging member) 801 around a separation projection rotate shaft 802.

However, since the separation projection 800 is made of hard material as described above, if its tip end or edge abuts against the pressing belt 731, the pressing belt 731 is scratched at the time of scraping of the sheet S due to the sharp edge or a fine burr in some cases. When an image is formed on the side of the pressing belt 731 on the sheet and it passes through the nip N, a fine surface state of the pressing belt 731 is transferred to a toner image surface after fixing. If a surface state on the pressing belt 731 is different, a difference in the surface state is generated on the toner image correspondingly and as a result, uneven brightness (gloss unevenness) is generated. This gloss unevenness appears seriously especially in a high gloss.

Thus, the tip end is not in contact with the pressing belt 731 and a flat surface abuts against the pressing belt 731 and a flaw of the pressing belt by the tip end of the separation projection is prevented, a sheet S is prevented from entering between the separation projection 800 and the pressing belt, thereby enhancing the separation.

Figure 7:
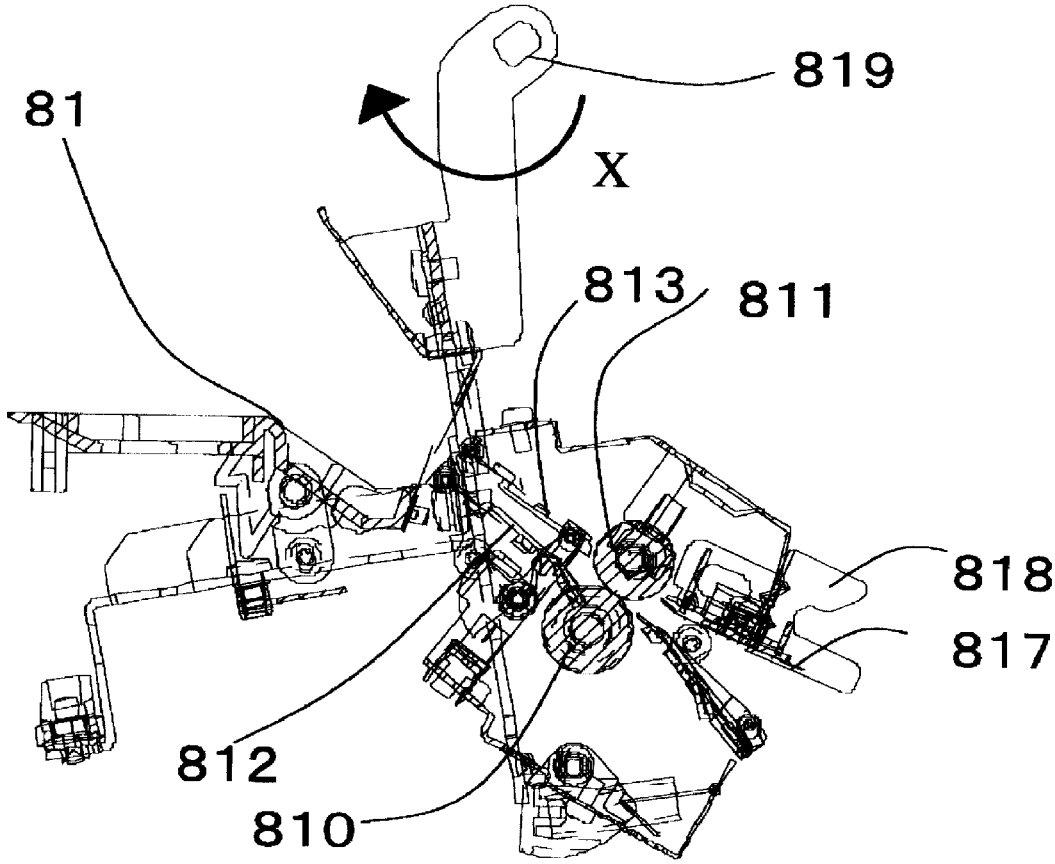
FIG. 7 is a sectional view of an open/close unit.

As shown in FIG. 7, the sheet S discharged from the nip N is nipped between and conveyed by the discharge roller 810 and the discharging follower roller 811, and guided by the conveying lower guide 812 and the conveying upper guide 813 and discharged out from the apparatus.

The tip end of the division plate 817 is close to the fixing roller 71 at a gap therebetween so as to prevent the sheet S from adhering to the fixing roller 71. To prevent the sheet S from adhering to the division plate 817 before toner on the sheet S is cooled and fixed, a PFA sheet member is applied to the division plate 817.

The separation projection 800, the division plate 817, the conveying lower guide 812, the conveying upper guide 813, the discharge roller 810 and the discharging follower roller 811 are held by a post-fixing discharging-side plate (deep side) 814 and a post-fixing discharging-side plate (front side) 815, thereby constituting an open/close unit (separating unit) 81.

The open/close unit 81 can rotate between a separating position where separating motion is carried out by an open/close unit rotating mechanism as a separating unit rotating device and a retracted position retracted from the separating position.

Figure 8:
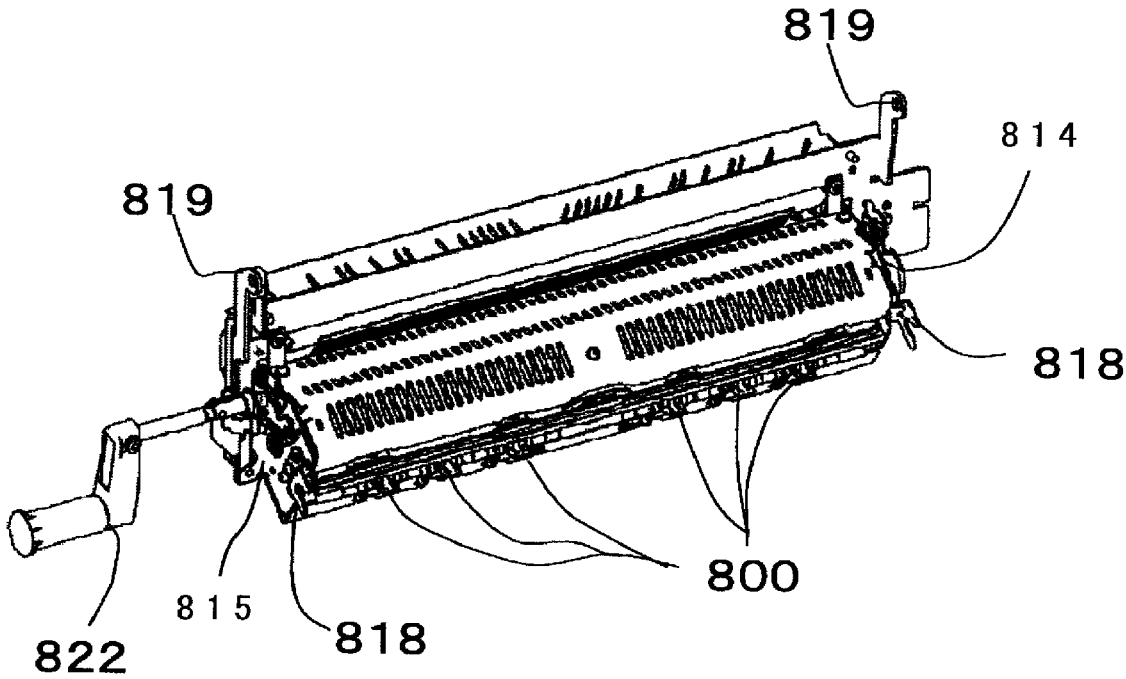
FIG. 8 is a perspective view of the open/close unit.

More specifically, the open/close unit rotating mechanism holds the open/close unit 81 and is pivotally supported by the rotate shaft 819, and the open/close unit rotating mechanism can rotate around the rotate shaft 819 such that the rotation direction at the time of opening is the same as the rotation direction of the fixing roller 71. The open/close unit 81 is fixed when a latch member 818 is latched to a shaft member 820 of the fixing apparatus 5 by a rotating operation using the open/close unit rotating mechanism. As shown in FIG. 8, the open/close unit 81 includes a handle 822 as a grasping portion for rotating operation, and includes a latch operating unit (not illustrated). If the latch of the open/close unit 81 is released by the handle 822, the open/close unit 81 is rotated in the direction of the arrow X, and the separation projection 800 and the division plate 817 can be retracted from the separating position.

(Access to Fixing Apparatus)

Next, a structure and effect to access to the fixing apparatus for convey failure or maintenance of a sheet will be described in detail using FIGS. 9 and 14 to 19.

Figure 9:
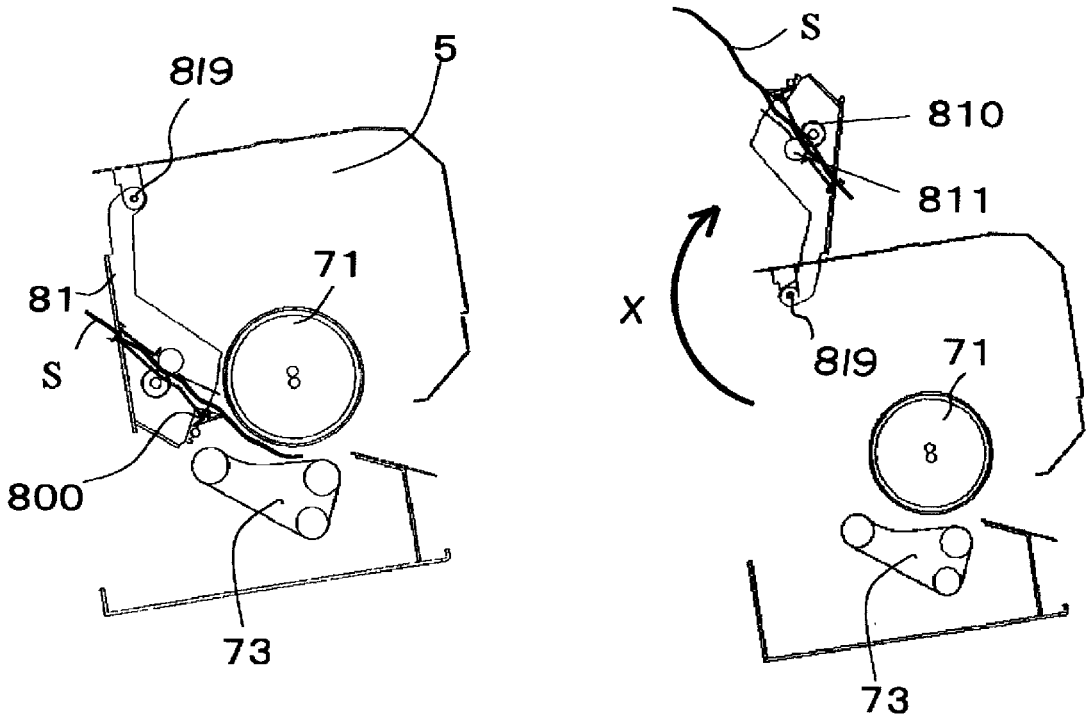
FIG. 9 is a sectional view for describing a rotating operation of the open/close unit.
Figure 14:
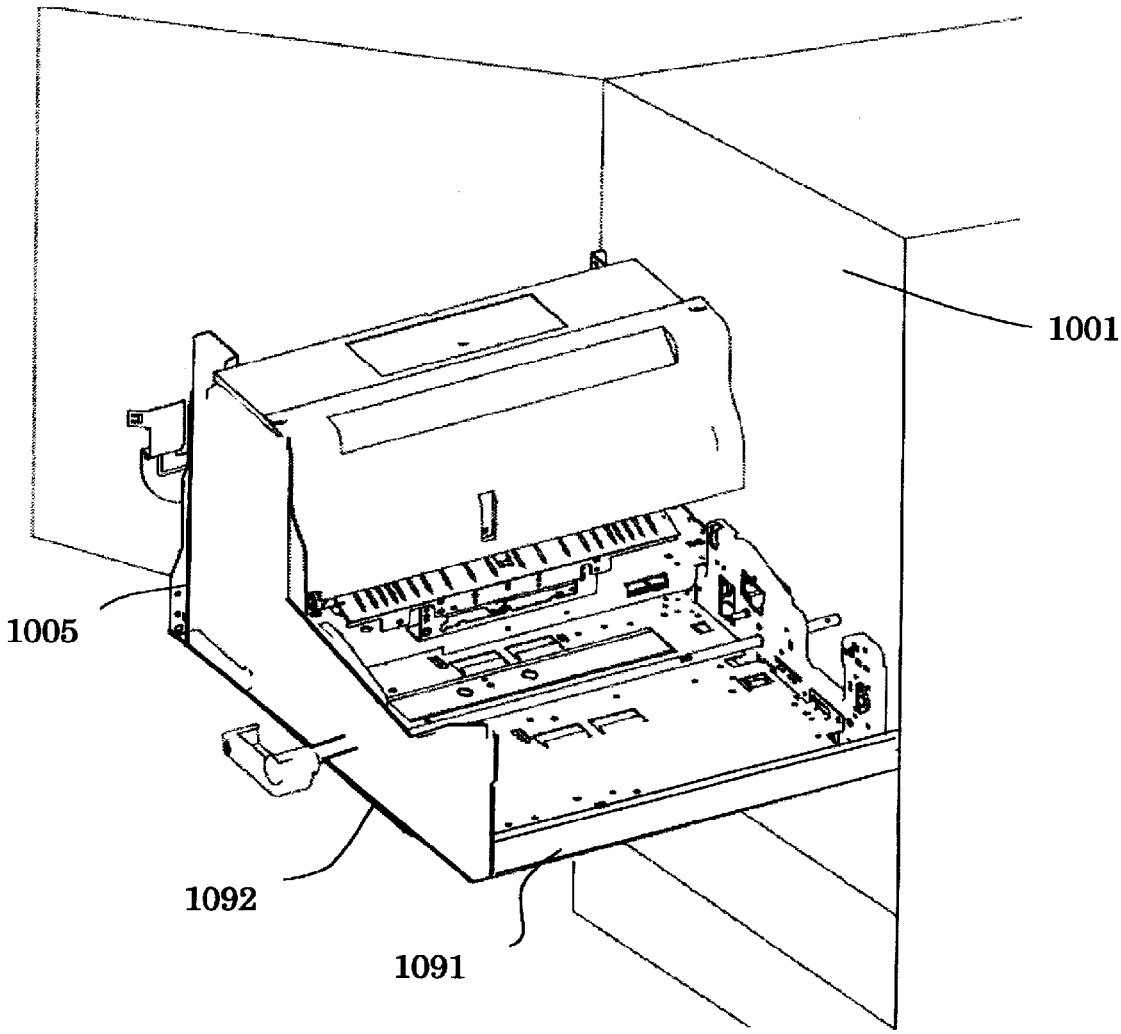
FIG. 14 is a perspective view of a state where the fixing apparatus is pulled out from the image forming apparatus.
Figure 15A:
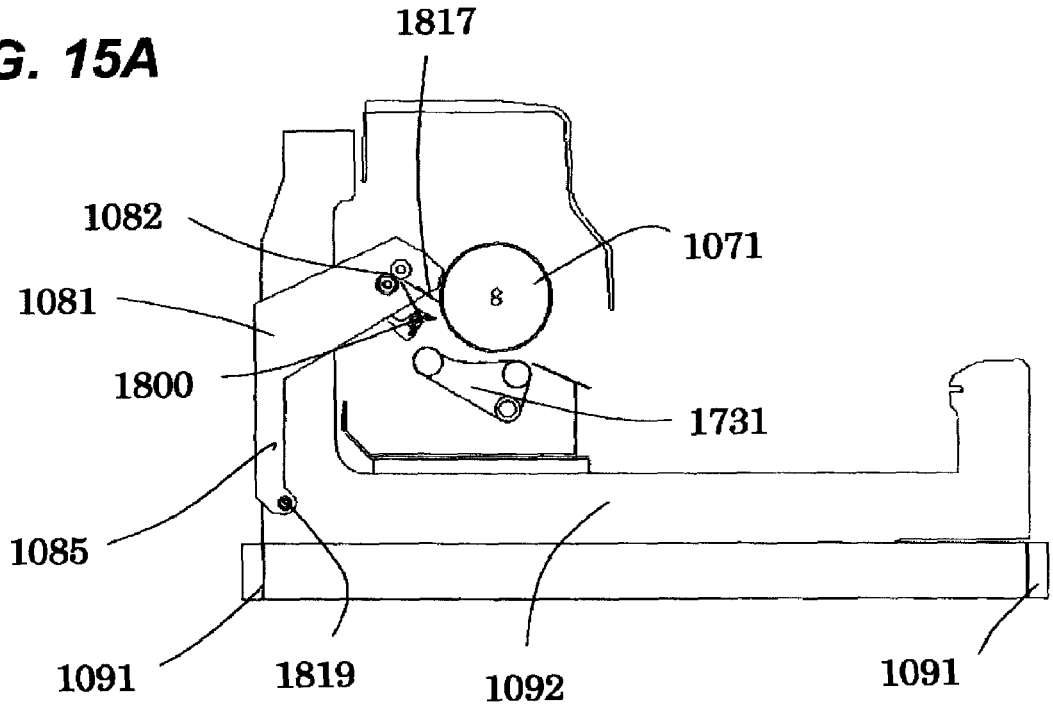
FIGS. 15A and 15B are sectional views of a conventional fixing apparatus.
Figure 15B:
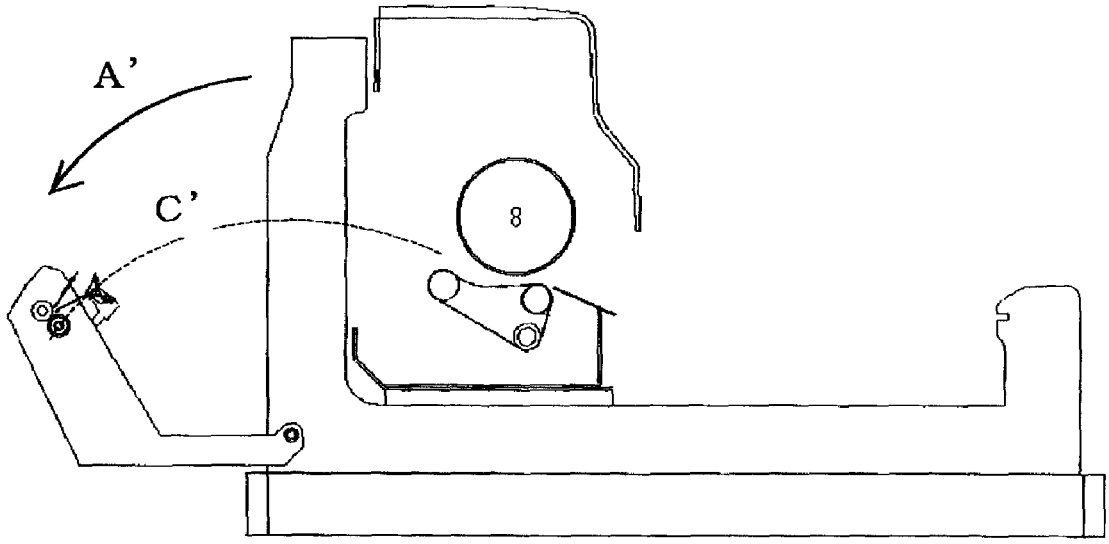

When accessing the fixing apparatus, as shown in FIG. 14, the fixing apparatus 5 is pulled out from the casing of the image forming apparatus, and the open/close unit 81 is opened as shown in FIG. 9. The handle 822 is rotated to release the latch, and the open/close unit 81 is rotated from the separating position to the retracted position in the direction of the arrow X. At that time, the discharge roller 810, the discharging follower roller 811 and the separation projection 800 immediately after the nip N are also rotated in a direction separating away from the fixing roller 71.

The rotate shaft 819 is provided with a damper mechanism (not illustrated), and if a resistance force is applied to the rotating motion in a direction approaching the fixing roller 71, it is possible to prevent the open/close unit 81 from abruptly closing. A toggle mechanism (not illustrated) is disposed on the rotate shaft 819, a force in the clockwise direction in FIG. 9 is applied at an angle in which the open/close unit 81 is held in its opened state, and the open/close unit 81 is pulled into the retracted position (open position).

As shown in FIG. 9A, when the convey failure is generated and the sheet S is stopped, the open/close unit 81 is opened as shown in FIG. 9B and the sheet S is processed. When the sheet S enters between the separation projection 800 and the pressing belt 731 also, as shown in FIG. 9B, a large jam recovery space can be formed between the separation projection 800 and the pressing belt 731. Therefore, the jam recovery performance can be enhanced. The division plate 817 for the fixing roller and the separation projection 800 for the pressing belt are unitized, and the division plate 817 can be retracted from the fixing roller and the pressing belt with a single operation. Therefore, usability is high.

(Lock Mechanism)

Next, a lock mechanism in which the pressing mechanism 75 pushes in the open/close unit 81 and locks the same, and pushing operation of the open/close unit 81 which is halfway fastened will be described in detail using FIGS. 10 to 13.

The pressing belt unit (pressing unit) 73 includes a push-up member (lock mechanism) 840 as an abutting portion. The push-up member 840 locks a separating unit (separation projection 800 and division plate 817) which are in the separating position when the pressing belt unit 73 is in a pressing contact position where the pressing belt unit 73 is in contact with the fixing roller 71 under pressure.

Figure 10:
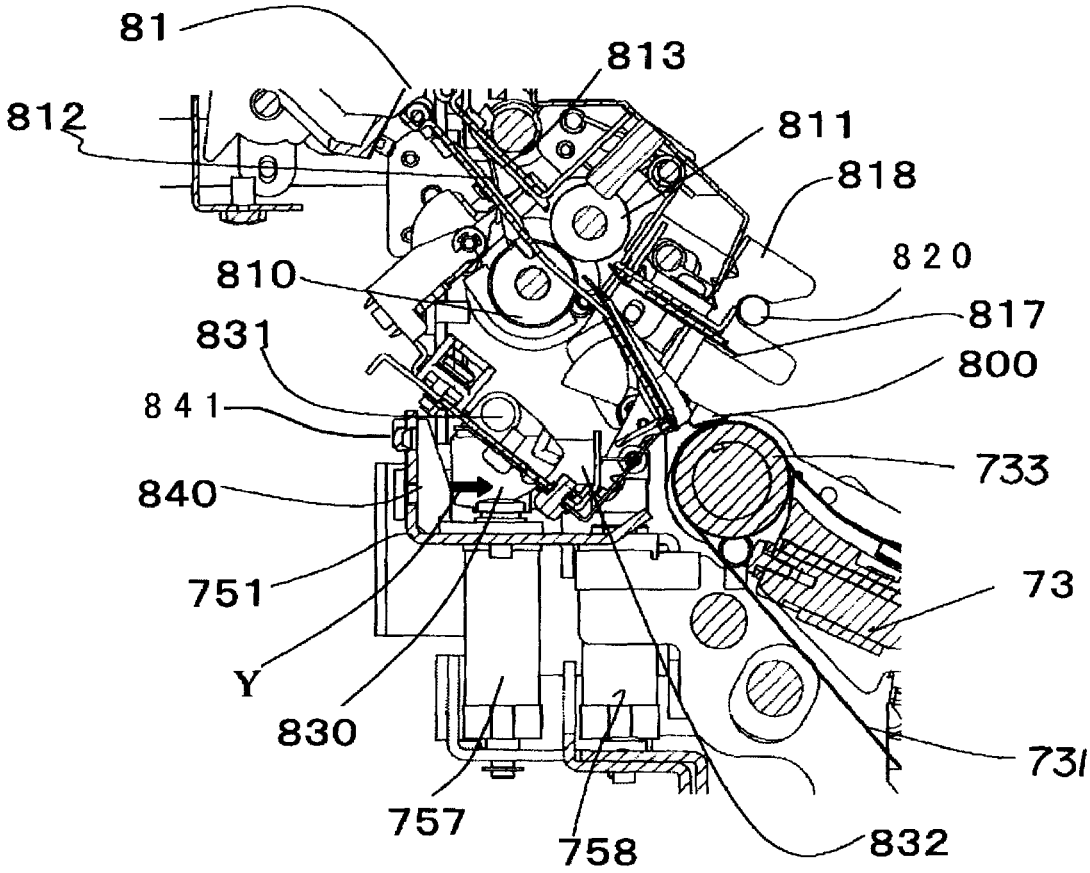
FIG. 10 is a sectional view for describing a fixing method of the open/close unit in a pressing state of the pressing unit.
Figure 11:
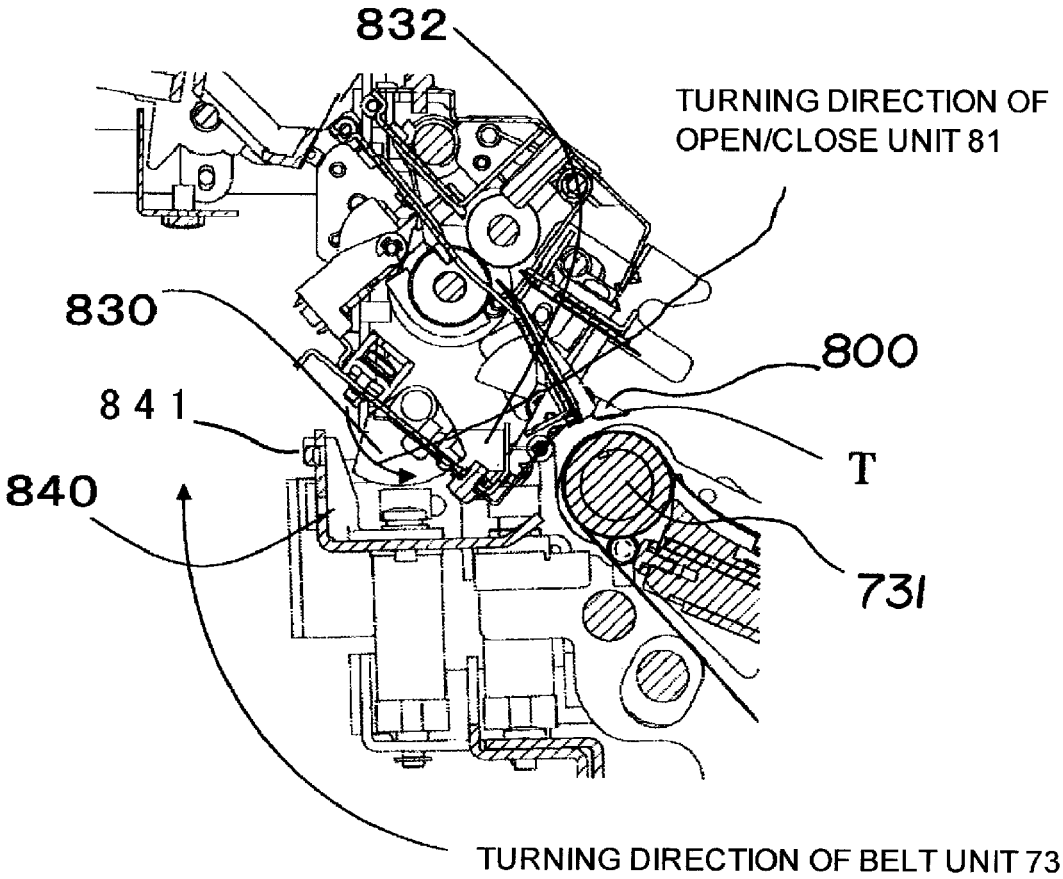
FIG. 11 is a sectional view for describing a fixing method of the open/close unit during pressing motion of a belt pressing unit.
Figure 12A:
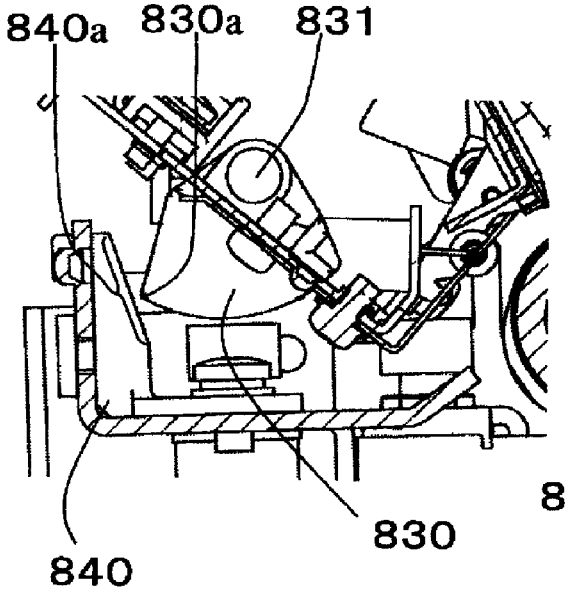
FIGS. 12A and 12B are sectional views of a lock mechanism.
Figure 12B:
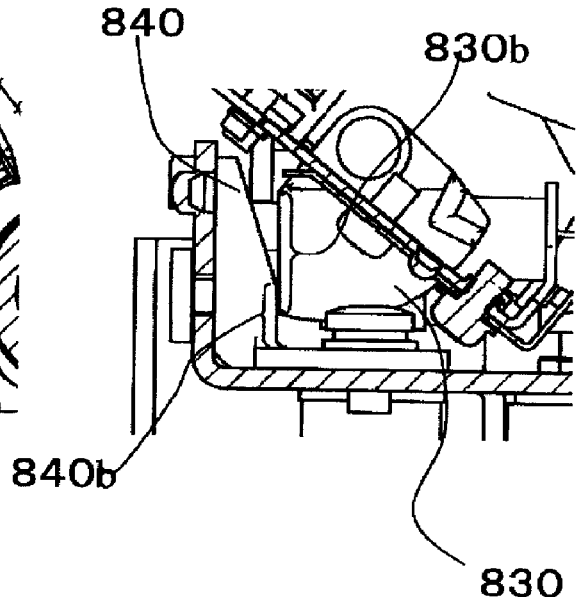

The locking motion when the pressing belt 731 is pressurized and the push-in motion of the open/close unit 81 when the belt is pressurized will be described. FIG. 10 illustrates that the belt is pressurized. FIG. 11 illustrates that the belt is being pressurized. FIGS. 12A and 12B illustrate details of a push-in mechanism which pushes the open/close unit 81 when the belt is pressurized and when the belt is being pressurized, respectively.

The open/close unit 81 includes a push-in member 830. The push-in member 830 is rotatably mounted on the open/close unit 81 through a push-in rotate shaft 831, and is pushed by a push-spring 832.

When the pressing belt unit 73 is pressurized against the fixing roller 71, the roller pressing holder 751 is pushed up. With this motion, an inclined surface 840*a* of a push-up member 840 mounted on the roller pressing holder 751 presses a top 830*a* of the push-in member 830, the inclined surface 840*a* rotates through a predetermined angle against the urging force of the push-spring 832, and this presses the open/close unit 81 in the direction of the arrow Y. With this, the open/close unit 81 rotates to the close position (separating position) illustrated with T in FIG. 11, the pressing belt 731 comes into contact with the separation projection 800 existing in the position T, and the pressing motion of the pressing belt 731 against the fixing roller 71 is completed.

In the pressurization-completed state, a flat surface portion 840*b* of the push-up member 840 presses a flat surface portion 830*b* of the push-in member 830, and the open/close unit 81 is pressed and is brought into the locked state.

Therefore, accidental unlatch during conveyance can be prevented. Further, since the open/close unit 81 is locked, the open/close unit 81 can not be operated in the state where the pressing belt unit 73 is pressurized. Thus, it is possible to avoid a case in which the open/close unit 81 is erroneously opened in the state where the pressing belt unit 73 is pressurized, the separation projection 800 and the pressing belt 731 slide on each other and a flaw is generated on the push-in rotate shaft 831.

When the pressing belt unit 73 is separated from the fixing roller 71, following the above operation in reverse, the roller pressing holder 751 is rotated downward, the push-up member 840 is separated from the push-in member 830 and is retracted from the rotating range of the open/close unit 81. With this, when the open/close unit 81 is opened, the pressing belt 731 is always separated from the fixing roller 71 and it is possible to prevent the separation projection 800 from damaging the pressing belt 731.

Figure 13:
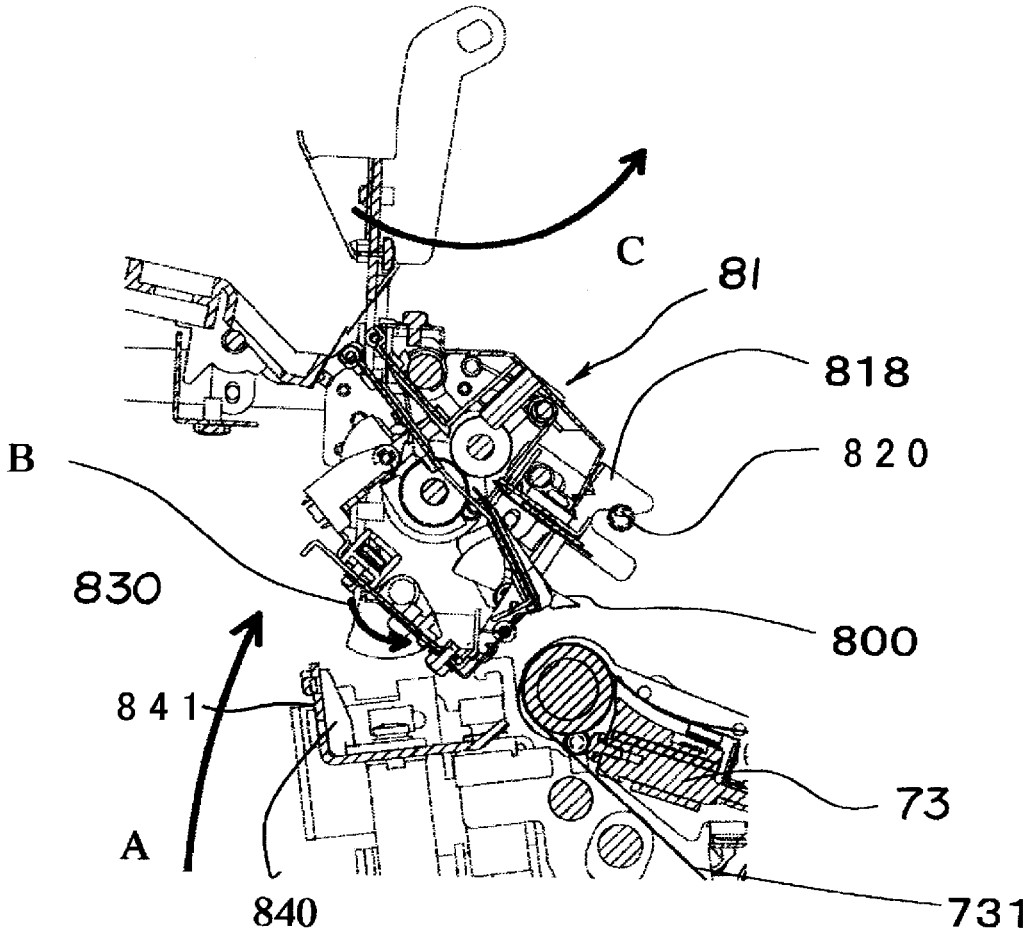
FIG. 13 is a sectional view for describing pushing motion by the pressing unit in a state where the open/close unit is halfway fastened.

Next, pressing motion of the pressing belt unit 73 in the semi-fastened state of the open/close unit 81 and the push-in motion of the open/close unit 81 will be described. FIG. 13 illustrates a state where the pressing belt unit 73 is being pressurized.

As shown in FIG. 13, if the pressing belt unit 73 pressurizes the semi-fastened open/close unit 81 in the direction of the arrow A, the push-up member 840 of the roller pressing holder 751 first comes into contact with the push-in member 830 of the open/close unit 81. In this state, the push-in member 830 is pressed in the direction of the arrow B and the open/close unit 81 is pressed in the direction of the arrow C.

If the open/close unit 81 is pressed in the direction of the arrow C, the latch member 818 of the open/close unit 81 is latched by the shaft member 820 mounted on the fixing apparatus 5. If the separation projection 800 is in the semi-fastened state, its position is not determined, and the separation projection 800 is in an instable positional relation with respect to the pressing belt 731, but since the open/close unit 81 is latched and set in the normal position, the separation projection 800 moves to the separating position T (FIG. 11). Thus, when the pressing belt 731 and the separation projection 800 come into contact with each other, the abutment relation between the pressing belt 731 and the separation projection 800 can be maintained.

In this embodiment, the rotating direction of the pressing belt unit 73 when the pressing belt 731 is retracted from the fixing roller 71 is opposite from the rotating direction of the separating unit (separation projection 800, division plate 817) when the separation projection 800 is retracted from the pressing belt 731. That is, the rotation direction of pressurization by the pressing mechanism 75 is in a calling positional relation with respect to the rotation direction in which the open/close unit 81 is closed. Therefore, it has the advantage over the push-in motion of the open/close unit 81.

The pressing belt unit 73 has a preventing portion 841 which prevent the separating unit (separation projection 800, division plate 817) located in the retracted position from moving to the separating position when the pressing belt unit 73 is in the pressing contact position. With this, in a pressing state where the pressing belt 731 is in contact with the fixing roller 71 under pressure, it is possible to avoid a case in which the open/close unit 81 closes and the separation projection 800 damages the pressing belt 731.

With this above structure, the open/close unit 81 can be held at the normal position by the lock mechanism by the operation in which the pressing belt 731 is pressurized against the fixing roller 71 without adding a toggle mechanism or a sensor, and it is possible to prevent the conveyance failure and deterioration in image quality inexpensively.

In this embodiment, an example in which the push-in member 830 and the push-up member 840 are in the position where they can come into contact with each other in the pressing motion is described, but the same effect can be obtained even if the position of the open/close unit 81 is roughly determined by another semi-fastening preventing mechanism and they the open/close unit 81 is pushed in. The order of abutting of the separation projection 800 and the pressing belt 731 is not limited to the embodiment, and the invention is not limited only if the contact position of the separation projection 800 and the pressing belt 731 is determined by the pressing motion.

Even if a portion of a part of a pressing mechanism abuts against a portion of the open/close unit 81 in the pressing state instead of the push-in member 830 and rotating of the open/close unit 81 is prevented, the same effect as that of the embodiment can be obtained.

Although the roller is used as the fixing member and a halogen lamp is used as a heat source in the embodiment, the present invention is not limited to this example only. For example, even if a belt is used as the fixing member and an induction heating system is employed, the invention can also be applied. Similarly, the pressing member is not limited to the belt and a roller may be used.

Even if a separation projection as a separating member is disposed at a small gap with respect to the pressing belt as a pressing member, the present invention can also be applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-111166, filed Apr. 20, 2007, which is hereby incorporated by reference herein in its entirety.

What is claimed is:

1. An image heating apparatus comprising: a heating member configured to heat a toner image on a sheet at a nip portion;

a pressing unit including a pressing member configured to form the nip portion with the heating member; a pressing unit moving device configured to move the pressing unit between an image heating position where an image heating process is executed and a retracted position where the pressing unit is retracted relative to the heating member; a separating unit including a separating member configured to separate the sheet from the pressing member, the separating unit is movable between a separating position where a separating process is executed and a retracted position where the separating unit is retracted relative to the pressing unit;

wherein the pressing unit includes an abutting portion configured to abut on the separating unit which is in the retracted position so that the separating unit is positioned at the separating position with a moving operation of the pressing unit from the retracted position to the image heating position.

2. The image heating apparatus according to claim 1, wherein the separating member is provided in the separating unit such that the separating member comes into contact with the pressing member when the separating member is in the separating position.

3. The image heating apparatus according to claim 1, wherein the pressing unit is rotatable between the image heating position and the retracted position about a rotation center which is closer to the pressing member than a sheet conveying path of the apparatus, and the separating unit is rotatable between the separating position and the retracted position about a rotation center which is closer to the heating member than the sheet conveying path.

4. The image heating apparatus according to claim 3, wherein a rotational direction of the pressing unit from the image heating position to the retracted position is opposite from a rotational direction of the separating unit form the separating position to the retraced position.

5. The image heating apparatus according to claim 1, wherein the pressing unit includes a preventing portion configured to prevent a moving operation of the separating unit from the separating position to the retracted position when the pressing unit is in the image heating position.

6. The image heating apparatus according to claim 1, wherein the separating unit includes a separating member configured to separate the sheet from the heating member.

7. The image heating apparatus according to claim 1, wherein the separating unit is movable from the separating position to the retracted position when the image heating apparatus is pulled out from a main body of an image forming apparatus.

* * * * *